US009517863B2

(12) United States Patent
Robinson et al.

(10) Patent No.: US 9,517,863 B2
(45) Date of Patent: Dec. 13, 2016

(54) MULTI-COMPONENT DISPENSER

(75) Inventors: Spencer Robinson, Bury (GB); Neil David Burdett, Sutton In Ashfield (GB); Alistair Jerome Richard Little, Belper (GB); Dale Martin Brooks, Alfreton (GB)

(73) Assignee: 2K POLYMER SYSTEMS LIMITED (GB)

( * ) Notice: Subject to any disclaimer, the term of this patent is extended or adjusted under 35 U.S.C. 154(b) by 492 days.

(21) Appl. No.: 13/811,135

(22) PCT Filed: Jun. 22, 2011

(86) PCT No.: PCT/GB2011/051168

§ 371 (c)(1),
(2), (4) Date: Mar. 28, 2013

(87) PCT Pub. No.: WO2012/010860

PCT Pub. Date: Jan. 26, 2012

(65) Prior Publication Data

US 2013/0221028 A1 Aug. 29, 2013

(30) Foreign Application Priority Data

Jul. 19, 2010 (GB) ..... 1012094.7
Feb. 10, 2011 (GB) ..... 1102403.1

(51) Int. Cl.
*B65D 35/22* (2006.01)
*B65D 35/44* (2006.01)
(Continued)

(52) U.S. Cl.
CPC ..... *B65D 35/44* (2013.01); *B05C 17/00513* (2013.01); *B05C 17/00553* (2013.01);
(Continued)

(58) Field of Classification Search
CPC ..... B05C 17/00556; B67D 81/3233; B67D 81/3244; B67D 81/3261
(Continued)

(56) References Cited

U.S. PATENT DOCUMENTS 1,944,201 A * 1/1934 Wharton ..... 222/95
2,130,284 A * 9/1938 Maddux ..... 222/92
(Continued)

FOREIGN PATENT DOCUMENTS

EP 0319666 A1 10/1988
EP 0653362 A1 9/1994
(Continued)

*Primary Examiner* — Patrick M Buechner
(74) *Attorney, Agent, or Firm* — Bacon & Thomas, PLLC

(57) ABSTRACT

A dispensing device for a multi-component composition comprising a housing (1) in the form of an elongate sleeve. The housing has a first end for receiving a compression device (3) and a second end defining an outlet (7) from which a supply of components housed within the housing are dispensed. Each component is retained within a compartment (21, 22) of a collapsible bag (2; 9, 10) prior to being dispensed. The collapsible bag compartments each have a sealed end for receiving pressure from the compression device and a dispensing end for dispensing a component via an outlet (23). The dispensing device is provided with a closure device (4) through which the dispensing ends of the collapsible bag compartments extend. The closure device (4) is adapted to apply a clamping force on the dispensing ends to seal off the supply of the components and to release the clamping force when required to allow the components to be dispensed.

11 Claims, 6 Drawing Sheets

(51) Int. Cl.
*B65D 83/00* (2006.01)
*B65D 81/32* (2006.01)
*B05C 17/005* (2006.01)

(52) U.S. Cl.
CPC ..... *B65D 81/325* (2013.01); *B65D 81/3261* (2013.01); *B65D 83/0072* (2013.01); *B05C 17/00556* (2013.01); *B65D 81/3233* (2013.01); *B65D 81/3244* (2013.01); *Y10T 29/4984* (2015.01)

(58) Field of Classification Search
USPC ..... 222/94, 490, 494
See application file for complete search history.

(56) References Cited

U.S. PATENT DOCUMENTS

| | | | | | |
|---|---|---|---|---|---|
| 2,715,479 | A | * | 8/1955 | Maddux | 222/92 |
| 2,947,448 | A | * | 8/1960 | Maddux | 222/92 |
| 3,323,682 | A | * | 6/1967 | Creighton, Jr. et al. | 222/94 |
| 3,666,145 | A | * | 5/1972 | Fisher | 222/107 |
| 3,884,396 | A | * | 5/1975 | Gordon et al. | 222/327 |
| 4,356,935 | A | * | 11/1982 | Kamin | 222/1 |
| 4,373,646 | A | | 2/1983 | MacEwen | |
| 4,711,373 | A | * | 12/1987 | Christine | 222/82 |
| 5,697,525 | A | * | 12/1997 | O'Reilly et al. | 222/105 |
| 6,199,725 | B1 | * | 3/2001 | Garibaldi | 222/207 |
| 6,398,077 | B1 | | 6/2002 | Gross et al. | |
| 2006/0006194 | A1 | * | 1/2006 | Niggemyer et al. | 222/107 |

FOREIGN PATENT DOCUMENTS

| | | | |
|---|---|---|---|
| EP | 1209098 | A1 | 11/2001 |
| EP | 1854737 | A2 | 11/2007 |
| EP | 2157026 | A1 | 2/2010 |
| GB | 2455372 | A | 6/2009 |
| WO | 2004086078 | A1 | 9/2004 |
| WO | 2007091071 | A1 | 8/2007 |

* cited by examiner

MULTI-COMPONENT DISPENSER

The present specification relates to a dispensing device for dispensing inter-reactive multi-component compositions. It also relates to a dispensing end for such a dispensing device, preferably in the form of an insert that connects to an elongate sleeve.

Dispensing devices for dispensing inter-reactive, multi-component compositions are already available and come in various forms. The components need to be kept separate until they are dispensed for use. The present invention is particularly concerned with dispensing devices where the components are housed within collapsible bag compartments, for example, a compartment of a capsule made from a flexible film or foil.

In the known arrangements it is common to remove the cap or mixing nozzle attached to the dispensing device, extract a dispensing end of a capsule from within a rigid sleeve or cartridge holding the components, remove a sealing clip, for example, by cutting it off with a knife in order to rupture the capsule, and then to reassemble the dispensing device so that it is ready for use. Usually this is a messy operation and there are further problems resulting from the components mixing or leaking within the dispensing device.

There have been a number of attempts to provide a dispensing device that avoids the user having to cut off a sealing clip prior to use. For example, it is known from WO-A-2004/076078 to provide a capsule that is sealed with a clip which is intended to slide off to rupture the capsule when a certain level of pressure is applied by the dispensing gun. It is also known to provide elements within the sleeve to rupture a capsule when pressure is applied by the dispensing gun, for example, in the form of knife blades in EP-A-0653362.

It would be desirable to provide alternatives to these arrangements where the dispensing device further facilitates re-use of the multi-component capsule after a portion of the components have been dispensed.

Further, a problem encountered with two component systems is that the components in their natural form have different rheologies. For example, they usually have different viscosities and one might exhibit a significant thixotropic characteristic (viscosity decreasing under shear) or a significant dilatant characteristic (viscosity increasing under shear). This generates lateral pressures that affect the resulting mixing ratios. Also low viscosity components are prone to leaking from the capsule. To account for this the usual approach is to use dispensing apparatus with separate rigid chambers and a piston for each chamber, for example, as is the case for the dispensing device in EP-A-0653362, or to modify one or both of the components to try to match the rheologies. However the components used in their unmodified form may have already gained an established track record and become recognised as achieving certain standards and approvals.

According to a first aspect of the present invention, there is provided a dispensing device for a multi-component composition, the dispensing device comprising a housing generally in the form of an elongate sleeve having a first end for receiving a compression device and a second end defining shoulders that taper to an outlet from which a supply of components housed within the housing are to be dispensed, wherein each component is retained within a compartment of a collapsible bag prior to being dispensed, the collapsible bag compartments each having a sealed end for receiving pressure from the compression device and a dispensing end, which has been ruptured or is capable of rupturing, for dispensing a component via the outlet, wherein the dispensing device is provided with a closure device that the dispensing ends of the collapsible bag compartments are arranged to extend through, the closure device being adapted to apply a clamping force on the dispensing ends to seal off the supply of the components and to release the clamping force when required to allow the components to be dispensed.

The closure device allows the capsule to be ruptured at the factory during the assembly process, and the dispensing apparatus is then 'ready for use', ready to dispense its contents without the user having to cut off sealing clips and re-fit the capsule. It may also allow partial discharge of the contents and then re-use after a period of time where the components are not mixed until downstream of the outlet.

The dispensing device is preferably in the form of a cartridge that is loadable into a dispensing gun, for example, a mastic gun. The sleeve may be the outer casing of the cartridge. Other embodiments are also envisaged where the dispensing device is a dispensing gun and the sleeve is a cylinder of the dispensing gun.

Preferably the closure device is located at the outlet of the housing. The dispensing ends of the collapsible bag compartments may protrude through the closure device and dispense the components, for example, into the base of a static mixing nozzle attached to the outlet of the dispensing device. The mixed components are then dispensed via an outlet of the mixing nozzle. In another embodiment, the closure device is located within a neck region of the dispensing device, positioned upstream of the outlet. In one embodiment, the closure device is provided within the housing at an entrance to a manifold section. The closure device may also serve to locate the dispensing ends of the collapsible bag compartments in position within the housing.

Preferably the dispensing ends of the collapsible bag compartments collectively form a common dispensing end for the capsule and the dispensing ends protrude through the same closure device. This would be the case where the capsule is formed with a collapsible bag compartment located within another, for example, where a collapsible bag compartment is provided by an internal fold of the material forming the capsule or by a separate internal tube. In such an embodiment the dispensing end of the outer collapsible bag compartment would encircle the inner one. Prior to assembly or use, a common sealing clip may be provided around the dispensing end of the outer collapsible bag compartment to seal both compartments. It would also be possible to form a collapsible bag compartment in an external fold of the material which forms the capsule and then the dispensing ends might be joined to form a common dispensing end. In another embodiment, the collapsible bag compartments are provided by two or more capsules that are held together, side by side, with the dispensing ends brought together as a common dispensing end that extends through the closure device.

As an alternative, the collapsible bag compartments may be provided by two or more capsules that have dispensing ends which are spaced from one another. These separated dispensing ends could then protrude through different closure devices, for example, closure devices that are each located at an entry to a chamber of a manifold section that is provided upstream of the outlet.

The closure device preferably has a circular configuration. When the closure device is provided at the outlet of the housing, this allows the mixing nozzle to be attached, for example, by screwing it onto the outlet over the top of the closure device. Other configurations, such as a linear, scooped or other profiled opening configuration, where opposing pressure surfaces are brought together in a clamping arrangement to close off the dispensing end of the capsule, are also envisaged.

The closure device preferably cooperates with a rotatable member, such as a cap or a ring, which is turned from a first position to a second position to open and close off the closure device. The act of turning the rotatable member may cause a set of fingers or elements around a mouth of an opening to be forced together so as to constrict and close off the dispensing ends of the collapsible bag compartments extending through the closure device by clamping them shut. Preferably a surface of the rotatable member urges against a surface of the fingers, forcing the fingers together. The rotatable member may be removed altogether during use when the components are being dispensed and then re-attached afterwards to seal off the supply of the components.

For example, the rotatable member may comprise a ring or cap that is screwed onto the outlet to close down a plurality of fingers onto the material of the collapsible bag compartments at their dispensing ends. The closure device may resemble a collet, through which the material that forms the dispensing ends of the collapsible bag compartments extends and is clamped thereby. The ring or cap preferably screws onto a screw thread that is provided on the outlet of the housing for attaching the mixing nozzle to the dispensing device. In such an embodiment, the ring or cap is removed before use by unscrewing it, leaving the closure device in an "open" configuration ready for dispensing the components when pressure is applied by the compression device.

Once the particular job has been completed, if the dispensing device still contains a supply of components that has not been used, then the user can remove the mixing nozzle and screw the ring or cap back on, forcing the fingers once more against the dispensing ends of the capsule to seal off the supply for storage until the next use. As the components are kept separate by the material of the collapsible bag compartments, the dispensing device can be re-used as and when necessary within the use-by lifetime of the product. A significant advantage of the dispensing device according to the present invention is that it can be used intermittently after the capsule has been ruptured.

Most preferably the rotatable member is in the form of a cap. In this way it can enclose the region beyond the outlet and trap any components that have been able to leak from the closure device prior to use or re-use, for example, components caught in the folds of material of the dispensing end between where the closure device seals off the dispensing end and where the dispensing end was originally ruptured through removing a sealing clip. Preferably the cap has an internal surface profile that provides a recess which extends over the outlet of the dispensing device in order to accommodate excess material of the dispensing ends. The recess may provide a head space of, say, greater than 1 mm, e.g., between 1-3 mm to accommodate any material of the dispensing ends protruding from the closure device on the outlet of the dispensing device.

Preferably the closure device comprises a plurality of fingers, extending in a substantially longitudinal and radial direction, that are arranged to urge against a neck of the capsule adjacent the point of rupture. Where sufficient biasing is provided through the resilience of the fingers or through other means (resilient bands, etc. applying force to close the fingers), the fingers may close off the capsule when the dispensing device is not in use. In some arrangements a rotatable member is used to urge the fingers into the closed position, and in such embodiments the fingers may hinge freely and rely on the rotatable member to provide the clamping action. The fingers are preferably arranged to come together to define a conical body, in particular a frusto-conical body, in the absence of pressure being applied to the capsule by the piston. Thus, in this closed form, the fingers may be inclined to the longitudinal axis of the sleeve with an edge of each finger abutting an edge of an adjacent finger, and the neck of the capsule being held tightly within a ring of fingers.

In its closed configuration, the closure device preferably defines an aperture that is substantially equal to or just slightly smaller than the volume of gathered material forming the neck of the capsule. In other words, the closure device may still provide an opening in its fully closed configuration. The opening should be sized to provide a tight fit around the gathered material forming the dispensing end(s). It may define an opening that is greater than 1 mm diameter, preferably greater than 2 mm diameter, and more preferably greater than 3 mm in diameter.

Preferably the closure device is a biased opening that is provided on an insert which engages the sleeve. Thus viewed from another aspect, the present invention can be seen to provide a dispensing device comprising a substantially rigid, elongate sleeve that is able to receive a piston at one end, a capsule fitted within the sleeve, the capsule holding a plurality of components each contained within a collapsible bag compartment of the capsule, the collapsible bag compartments being sealed at one end where the piston will apply pressure and being ruptured or being capable of rupturing at a dispensing end for dispensing the components via an outlet of the dispensing device, wherein the dispensing device includes an insert within the sleeve, the insert being provided with a biased opening, for example, a resilient orifice, that fits over one or more of the dispensing ends such that material forming the particular collapsible bag compartment extends through the biased opening towards a point of rupture.

Hence, preferably the closure device functions as a valve. It is able to allow component to be dispensed when pressure is applied to the capsule, but it is also able to shut off flow from the capsule when pressure is no longer applied. Often one of the components in an unmodified form can be especially fluid and the closure device, particularly when it is used in conjunction with a manifold upstream of the outlet, can prevent excess component from leaking back along the inside of the sleeve. An advantage is also that the closure device can seal off the collapsible bag compartments to prevent leakage. This is of concern not only in terms of ensuring that exact mixing ratios of components are dispensed, but also for reducing possible mess during use and enabling re-use of the sleeve afterwards with a new capsule, thereby minimising wastage and allowing parts to be recycled.

The closure device may have an aperture portion comprising a ring of fingers and a body portion comprising a ring of material that a base of the fingers extends from. It may be integrally formed with the insert or it might be moulded separately and joined to the insert, either during the manufacturing operation or during the assembly of the dispensing device.

In one embodiment, the insert comprises a shoulder portion of the dispensing device. For example, the insert may be of circular form having an external diameter or a region of external diameter corresponding to an internal diameter of the elongate sleeve. During the assembly stage, the dispensing ends of the collapsible bag compartments can be pushed through the biased opening of the insert and the sealing clip removed to rupture the capsule.

In this 'ready for use' condition, the capsule can be slid into the sleeve and the assembly pushed until it is properly engaged with the sleeve. The assembled cartridge is then ready for use and might be usable intermittently over an extended period.

Preferably the insert is moulded as a single piece, for example, having circular form when viewed along a longitudinal axis. A circular cross-section is standard and would allow use in generic dispensing guns but other shapes would work equally well, such as oval cross-sections, or polygonal cross-sections (triangular, square, hexagonal, etc). However, for certain applications it may be preferential to mould the insert as several pieces that are joined together, and it may be further preferential to mould the biased opening from a different material offering greater resilience.

In several embodiments the closure device, for example, a biased opening of the insert, is located internally of the sleeve. However, there is an important embodiment of the present invention where the closure device of the insert is located externally of the sleeve at a location beyond an end of the elongate sleeve. In this embodiment the insert forms the shoulders of the dispensing device and preferably has a substantially conical internal surface which the capsule is pushed up against. The insert may provide a dispensing end for the sleeve, where the parts together form the body of the dispensing device. The insert preferably includes a neck section of reduced internal diameter that creates a funnel shape leading to the closure device. In such embodiments a rotatable member may be used to close down the fingers onto the dispensing ends of the collapsible bag compartments.

The insert of this embodiment may be provided with an external screw thread, onto which a screw cap is located, the cap having an internal surface profile that is adapted to urge against an outer surface of the fingers to close them together and thereby close off and seal the ruptured capsule by trapping the capsule between the fingers of the closure device. Preferably the external screw thread on the insert has dimensions for receiving a standard mixing nozzle once the cap has been removed. The position of the closure device should be such that, whilst the cap can be located to close down the fingers of the biased opening, the internal surface of the mixing nozzle does not interfere with the operation of the biased opening, or does not interfere to any noticeable degree. Preferably the internal surface of the end of the cap is substantially conical and of the same profile as the conical body of the closed down aperture portion. This enables it to abut against the closure device, which is preferably in the form of a biased opening, and urge it to a closed configuration. The internal surface of the cap may further include a recess to accommodate a length of gathered material of the capsule located between the aperture portion of the biased opening and the point of rupture of the capsule.

According to yet a further aspect of the present invention there is provided a dispensing end for a dispensing device, the dispensing end being adapted for connection to an elongate sleeve housing a capsule of pumpable medium, the dispensing end further including: a substantially frusto-conical interior surface providing a shoulder portion for the dispensing device that supports a discharge end of the capsule in use; a neck region of reduced section downstream of the shoulder portion, the neck region providing a threaded exterior surface for attaching a mixing nozzle; and an outlet downstream of the neck region for discharging the pumpable medium of the capsule, wherein the outlet comprises a closure device in the form of a plurality of fingers that are arranged to encircle the outlet, the fingers extending from the outlet to provide a variable opening at their tips, through which one or more dispensing ends of a capsule protrudes in use, wherein in a closed configuration, the fingers abut one another to define a substantially conical mouth structure, more preferably a frusto-conical mouth structure, which is arranged to clamp around gathered material from a dispensing end of a capsule in order to seal it.

Thus the opening preferably comprises a collar or nozzle of resilient fingers. The innermost surface of the fingers may provide a cup-like recess in which to seat the dispensing end of the capsule. The fingers converge towards a point and may abut one another in a closed configuration to create a substantially frusto-conical form with a small opening to accommodate a neck of the flexible film of the capsule. When pressure is exerted within the capsule, the contents of the chamber will cause the fingers to splay out, enlarging the opening. The fingers may be biased against the surface of the flexible film through the resilience of the material. Preferably additional biasing is provided through a stretchable ring that extends around the collar, for example, using elastomeric rings of different elasticity or thickness to adjust the biasing provided to the collar. A retaining formation on an outer surface may be provided for retaining an additional biasing element, for example, an elastomeric ring or spring clip, in position around the collar. The retaining formation might be an outward flaring at the ends of the converging fingers.

The dispensing end is preferably an insert that slides into engagement with the elongate sleeve. Such an insert would be used in conjunction with a tubular sleeve to provide the complete dispensing end region of the cartridge or dispensing device. This has additional benefits as a tubular sleeve is much easier to manufacture than an injection moulded outer casing with integral conical surfaces at one end. Preferably the tubular sleeve is made from a recyclable material. In one embodiment, the tubular sleeve is a cardboard roll.

The dispensing end may include a section that is of the same diameter as the internal diameter of the elongate sleeve. Frictional engagement alone may suffice to keep the dispensing end attached to the sleeve, since in use, the connection between the dispensing end and the sleeve would be under compression between the collar and the piston of a dispensing gun. Adhesive or mechanical elements, such as lugs and recesses may also be used to secure the parts together. In an alternative arrangement, the dispensing end may fit externally of the elongate sleeve, for example, as a large cap to close off one end of the sleeve. Thus the dispensing end may include a collar having an internal diameter corresponding to an external diameter of the elongate sleeve. Again, friction can be relied on to hold the components together, or if preferred, an adhesive or mechanical fixing can be used.

Although the capsule may be provided with a weakened area that ruptures under pressure or with a clip that is set to release once pressure is applied to the capsule, there can be variance in these mechanisms, particularly in the clip properties as a result of the manufacturing process, and this can make the popping-off of the clips or the rupture of the compartments unreliable. By pre-removing the clips during the production of the dispensing device, it removes this source of unreliability. It also prevents the clips from potentially blocking the dispensing device. It further allows the dispensing device to be used with any type of mixing nozzle, whereas previous products required a specific nozzle to catch the clip without blocking.

During use of the dispensing device, it can also be advantageous if the flow of the components is controlled. In embodiments where the closure device is located within the sleeve, preferably the dispensing device is provided with a manifold section and the collapsible bag compartments have separate dispensing ends. The dispensing device preferably has more than one closure device corresponding to the number of dispensing ends. The closure device when in the form of a biased opening can also act as a regulator, responding to the pressure within the collapsible bag compartment and exerting a reaction force that helps to restrict or regulate the flow of components from the capsule. The properties of each closure device can be chosen to take account of the different rheological properties or mix ratios of the components, balancing the flows of the components under normal operational pressures as much as possible, which in turn leads to improved dimensional stability of the capsule during use.

For example, in the situation where a more viscous component is provided in a collapsible bag compartment next to one with a less viscous component, the lateral pressure exerted on the collapsible bag compartment of the less viscous component by the more viscous component can be taken into account in the choice of the closure devices to provide a more controlled mixing. In many instances it may be desirable to have a different size of closure device, e.g., a biased opening, to accommodate different rates of flow at a given pressure within the capsule or capsules, e.g., in situations where the mix ratio is not one to one, or to accommodate other rheological characteristics. For more fluid components, for example, a more flexible material may be chosen for the material of the biased opening, the fingers may be made thinner or may be fewer in number, the elastomeric band or other biasing element may produce less of a biasing effect or may even be omitted from the biased opening. Thus such embodiments facilitate the use of capsules having components with significantly different rheologies that are able to be dispensed reliably using a conventional 'mastic gun' type dispenser with a single piston driving out the components from within the housing of the dispensing device simultaneously.

A restriction for one or more of the components may also be incorporated further downstream within the manifold section in order to control the mixing characteristics of the dispensing device further. This could be a static or a dynamic constriction.

The insert of these embodiments may comprise a manifold section made from one or more components. In one embodiment the insert is provided as two mouldings, e.g., as two semi-circular or other shape elements arranged back-to-back, each providing a manifold to direct one of the components to the outlet of the dispensing device. The manifold section can also prevent the component from leaking back along the sleeve. The manifold section further serves to locate the dispensing ends of the capsule or capsules at an appropriate position within the sleeve. Again this helps to maintain the dimensional stability of the capsule.

The insert is provided with a locating means to position it correctly within the outer casing and in one embodiment this comprises a projection, for example, a circumferential projection which engages with a recess provided in the inner surface of the sleeve. The projection and recess are easily formed during the moulding operations. In another embodiment, the locating means comprises a plurality of projections. More preferably, the locating means comprises a circumferential rim which engages an annular recess in the sleeve.

The closure devices may comprise biased opening members that are a separate moulding to the insert. Each biased opening member preferably engages a hole in the insert and is secured to it in a snap-fitting manner. In this way each capsule can be pre-fitted with a biased opening member that fits over the neck of the capsule and is secured in place with adhesive. The sealing clip may then be removed. The capsule can be slotted up the sleeve until the biased opening member engages, preferably in a snap-fitting manner, a corresponding hole in the insert, such that the capsule is then held securely in place by the biased opening member.

In the embodiments where the collapsible bag compartments are provided by two or more separate flexible film/foil packages, for example, as a pair of sausage-like chambers, then preferably the collapsible bag compartments are preformed with a flattened side. Thus for a one to one mixing ratio the collapsible bag compartments can be moulded using a semi-circular profiled mandrel to form a semi-circular chamber prior to filling. For other mixing ratios, different shapes may be used. This allows the collapsible bag compartments to be brought together at their flattened faces to provide a capsule of circular cross-section. The chambers may have cross-sections corresponding to any segment or sector of a circle, or they may have other shapes where co-operating flattened or profiled faces are joined together to form the completed capsule. Assembling the collapsible bag compartments to form a final shape, which corresponds to the sleeve of the cartridge or the barrel of a gun, helps to facilitate the insertion of the capsule. Moreover, the two or more collapsible bag compartments can be wrapped in a further film to hold them together, which can additionally help to assist handling.

Moreover, it can be difficult to provide information on the side of a capsule because the final position of the printed surface may be unpredictable. Using a separate film to wrap the collapsible bag compartments together allows instructions and other printed matter to be provided in a predictable and clear way on the side of an assembled and wrapped capsule. This is particularly useful where the capsule is not used in a cartridge but instead a re-usable dispenser gun. The film wrap may be chosen to have other properties such as a low coefficient of friction with material of the sleeve or barrel, in order assist with loading the capsule into the cartridge or barrel of a gun. This concept can be applied also where there are more than two components, for example, three or four components, e.g., with the chambers preformed with a cross section corresponding to a sector of a circle.

Certain embodiments of the present invention will now be described in greater detail and by way of example only, with reference to the accompanying drawings, in which.

Figure 1:
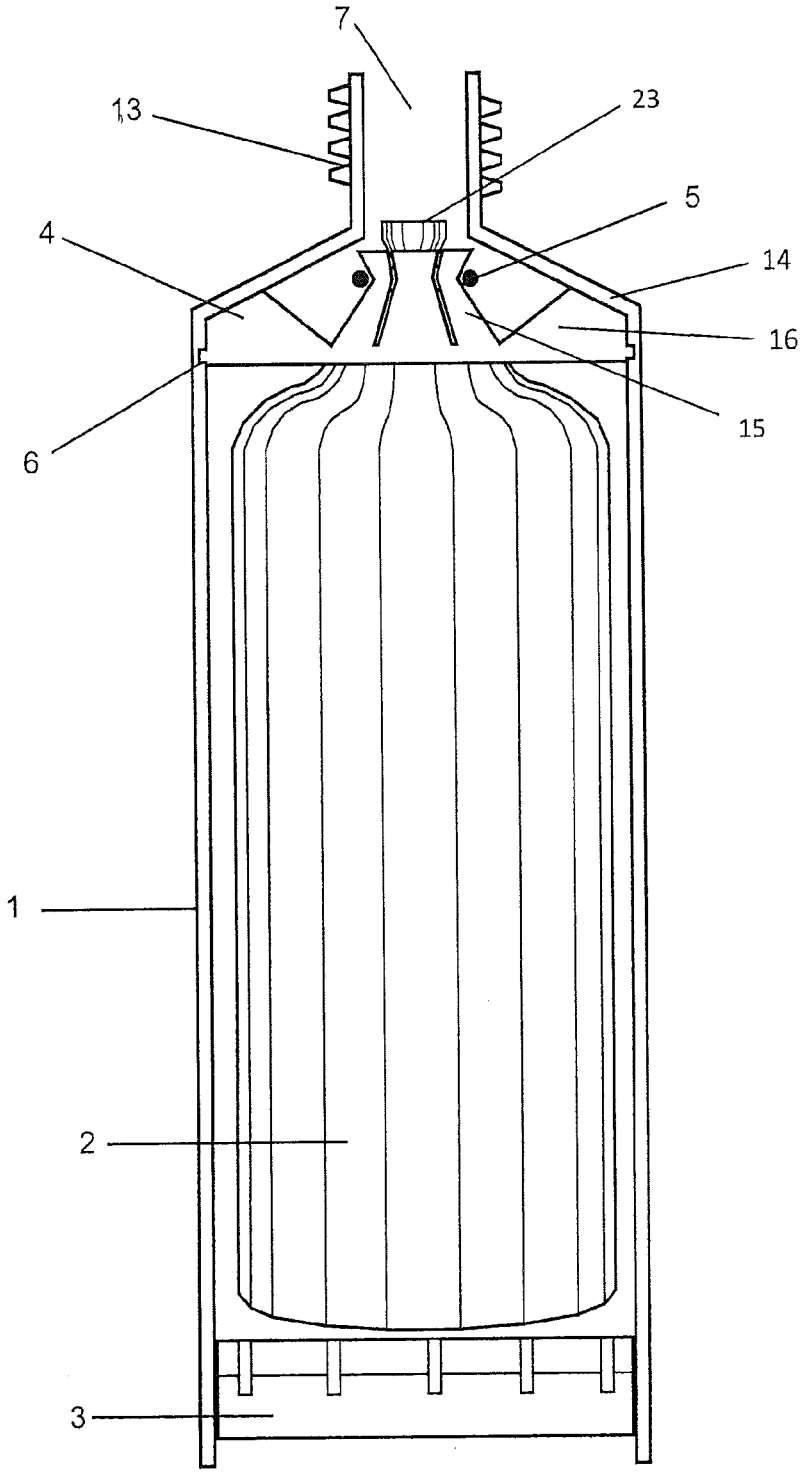
FIG. 1 is a cross section of a dispensing device in accordance with a first embodiment the invention.

Cartridges containing multi-component compositions are known in various forms. Generally they comprise two or more separate collapsible bag compartments, each housing a respective component. These components, in use, are extruded or otherwise expelled through an orifice in their respective compartments into a static mixing device, where they are caused to mix and react together. The typical collapsible bag is preferably elongate and filled in the manner of a sausage, cut to the desired length, and sealed at both ends. In use, a first end is opened in a suitable manner to allow the contents to be dispensed. The second end remains closed and is squeezed by a compression device to dispense the component. In prior art systems this can be a difficult and messy process.

In accordance with the present invention there is provided a dispensing device for an inter-reactive multi-component composition. The dispensing device comprises a capsule in the form of a plurality of collapsible bag compartments (a collapsible bag formation) that are located within a substantially rigid housing. Each compartment houses a respective component and has an opening at a dispensing end of the bag. The dispensing device is adapted so that the dispensing ends of the collapsible bag compartments communicate fluidly with a mixing nozzle or other suitable dispensing formation at a dispensing end of the housing. The housing acts as a guide tube for a compression device. An opposite end of the collapsible bag compartments within the guide tube is exposed to a compression device acting in use to collapse the collapsible bag compartments and encourage the components towards the openings at the respective dispensing ends. Each dispensing end of the collapsible bag compartments protrudes through a closure device, which opens and closes selectively during operation of the device.

The closure device provides an openable closure that opens to allow extrusion of the contents during operation of the dispensing device and closes to seal the compartment when the dispensing device is not in use.

In one embodiment the closure device is biased to a closed position so that it closes off the opening of a collapsible bag compartment but is adapted to open once a predetermined pressure has been exceeded. In one example the closure device acts as a valve, allowing product to flow only one way. Thus, the closure device seals the compartment when no pressure is applied by the piston when the dispenser is not in use, but opens to allow extrusion of product when enough pressure is applied by the piston when the dispenser is in use. The closure device self-seals the compartment when the piston is not applying pressure, i.e. when the dispenser is not in use.

In another, the closure device is closed by a rotatable member preferably in the form of a cap or ring that acts on an aperture portion to close down the closure device onto the material of the dispensing end. Prior to use, the rotatable member may be removed to open the closure device, and afterwards the rotatable member is replaced to close it off again.

The housing preferably also serves as a guide means for the compression device in use. The compression device preferably moves along within the housing in a longitudinal direction. The housing may thus comprise a guide tube for the compression device. The compression device may be a piston deployable longitudinally within the guide tube to apply pressure to the collapsible bag housed within.

Referring first to FIG. 1, a two component dispensing device in accordance with a first embodiment of the invention is shown in longitudinal cross section.

The dispensing device has a multi-compartment flexible membrane bag 2 that contains multiple components. That is, a single bag is preformed to define a plurality of separate compartments, each of which carries a component that is flowable under pressure. In a specific embodiment (not shown), the bag defines two compartments, one for a major and a minor component, which together form a single elongate sausage.

The collapsible bag 2 is housed in a tube 1 which forms a solid housing that wholly encloses and houses the bag 2 to provide a cartridge. The housing provides a rigid support structure for the collapsible bag and may comprise a rigid plastics material, a cardboard tube or the like. The tube 1 also acts as a means in which the compression device, e.g., a piston 3 may slide to bring pressure to bear on the bottom end of the elongate sausage formed by the filled bag 2, causing the fluid component from each compartment to be extruded out of the common opening 23 at the top of the bag 2.

The common open end of the bag 2 feeds the components into an outlet 7 at the top of the tube 1. The outlet has a screw thread 13 for the attachment of a dispensing unit (not shown) which may include a dispensing nozzle, static mixer body etc.

At the end of the tube 1 in the region where the bag 2 opens into the outlet 7, the tube 1 narrows via shoulders 14 and a valve 4 is located.

Figure 2:
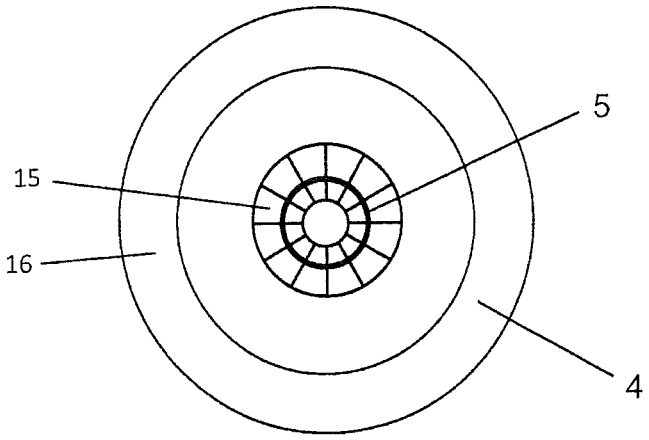
FIG. 2 is a plan view of a valve suitable for use in the embodiment of FIG. 1.

An example of a valve 4 is shown in FIG. 2. When in place, the internal walls and/or the shoulders 14 of the tube 1 engage with parts of the valve 4 to locate the valve 4 in position in the tube 1. The valve 4 comprises a central portion 15 and arranged around it a flexible elastomeric ring 5 which is seated on the central portion 15 and arranged to surround the bag outlet 23.

The valve 4 performs two functions. First, the central portion 15 squeezes together the flexible membrane of the bag 2 with sufficient force to keep the bag 2 closed in the absence of any pressure being applied by the piston 3. However, when sufficient pressure is applied to the bag 2 by the piston 3 the valve 2 opens to allow the components contained within the bag 2 to be discharged into the tube 1 at the outlet 7. Once the pressure is released, the elastomeric ring 5 then closes the valve 4 to reseal the bag 2. Thus the bag 2 self-seals when not in use.

Second, a body portion 16 of the valve 4 is located within the shouldered region of the tube 1 so as to secure the opening 23 of the bag 2 in position mechanically. Complex manifold structures or the application of secondary fixing means, adhesives etc are not required. The body portion 16 may engage with an inner wall of the tube 1 by simple interference fit, but more preferably a locating element 6 is provided to create a positive lock. This may comprise an interlocking ridge and recess as shown with a recess in the tube wall. This arrangement allows the shoulder region 14 of the tube 1 to act as part of a manifold.

To assemble the cartridge, a filled bag 2, with both ends sealed in a known manner, is taken and a valve 4 is fitted on one end, to close the bag 2 and allow the sealing member to be removed from the bag at a point above the valve 4. The valve 4 and the bag 2 are then pushed up the tube 1 into locking engagement with the recess in the tube wall. The valve 4 both seals and locates the bag 2 within the tube 1.

No additional locating step is needed. The assembly is a ready-to-go system with a seal-sealing device to assist the user, without a need for a cutting device (such as described in EP754633) or any repeatability issues due to the rupturing of a weakened area (such as described in WO2004/076078). The body portion 16 of the valve 4 provides a lower part of a manifold that mitigates "flow back" into the main body of the tube 1. The self-sealing nature of the valve 4 makes the dispensing device re-usable/part usable unlike the prior art systems mentioned with one-time openings.

Figure 3:
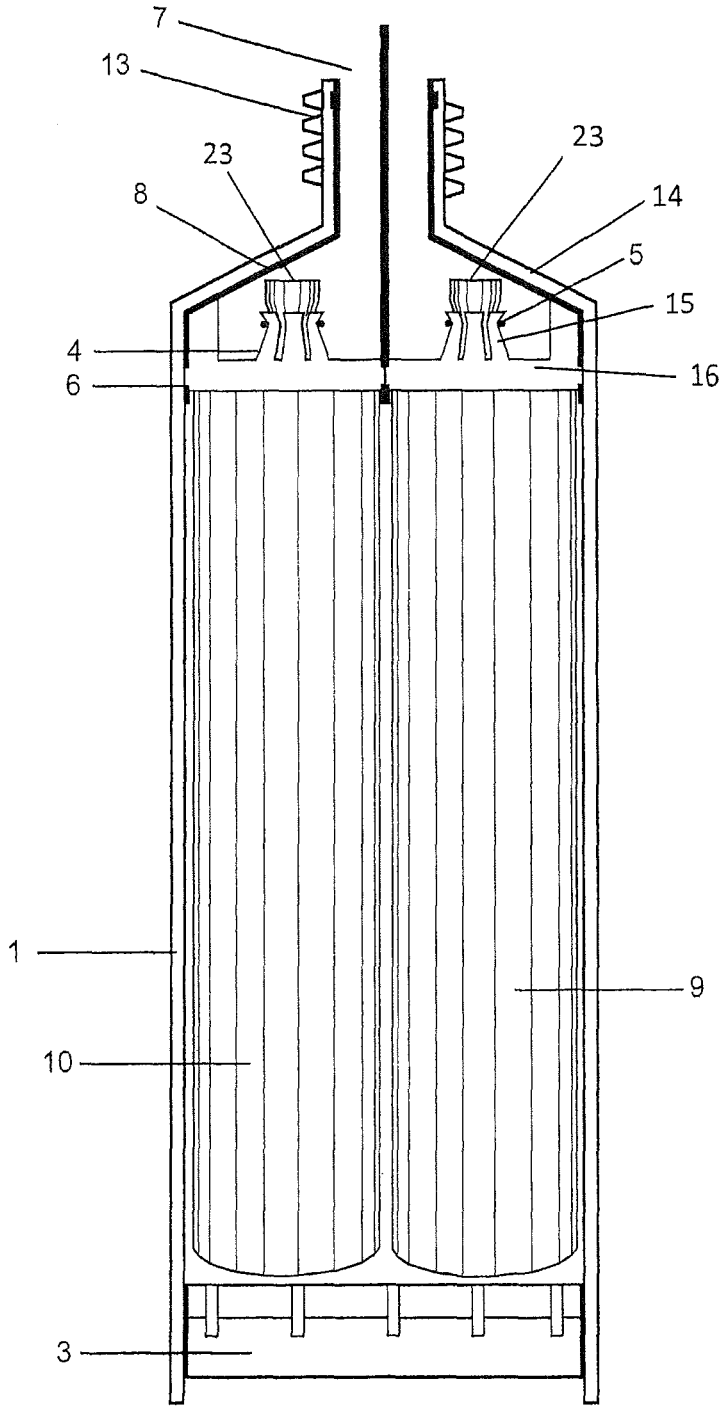
FIG. 3 is a cross section of a dispensing device in accordance with a second embodiment the invention.

FIG. 3 shows a further embodiment of the dispensing device in longitudinal cross section which is in the form of a two component cartridge dispenser. Most features of the dispensing device of FIG. 1 and FIG. 3 are the same and where applicable like reference numerals are used.

In this example each component is provided in a separate flexible bag. A first bag 9 is a single compartment, single component, flexible membrane bag filled with component A. A second bag 10 is a single compartment, single component, flexible membrane bag filled with component B. The bags as a result form a pair of elongate sausages.

The bags 9, 10 are housed side by side in a tube 1, which forms a cartridge that wholly encloses and houses the bags. The tube 1 also acts as a means in which the piston 3 may slide to bring pressure to bear on the bottom end of each elongate sausage to extrude the component through the opening 23 at the top of each bag 2.

The openings 23 of the bags 9, 10 feed into the shoulder region of the tube 1 which leads into the outlet 7. The outlet 7 has a screw thread 13 for attachment of a dispensing unit (not shown) which may comprise a dispensing nozzle, static mixer body etc as familiar.

A further difference in this embodiment is the provision of a manifold structure 8 in the shoulder region of the tube 1, providing a valved manifold arrangement for the two or more bags 2.

The manifold 8 is designed to direct the flow of the components from the two or more bags 9, 10 to the outlet 7 of the tube 1. Each opening 23 of the bags 9, 10 feeds into an inlet of the manifold 8 in the shoulder region of the tube 1. The manifold 8 defines separate channels for the material to flow from each bag 9, 10 to the outlet 7. The valve 4 on each bag 9, 10 provides the inlet to each channel of the manifold 8.

The valve 4 at each opening 23 of the bags 9, 10 may be based on the example in FIG. 2. Thus, the valve 4 comprises a central portion 15 with an aperture and a flexible elastomeric ring 5 which is seated on the central portion 15 and arranged to surround the bag outlet 23. The valve 4 is retained in position by engagement of portions of the manifold 8 with parts of the body portion 16, of the valve. In a typical embodiment a body portion 16 of the valve 4 has the same dimensions as one of the sectors of a manifold 8. Each valve 4 may be a discrete structure, or multiple central portions 15 may be provided with a common valve body portion 16.

Again, the valve 4 performs two functions. The action of the elastomeric ring 5 automatically closes the valve 4 and reseals the bag 9, 10. The bag 9, 10 self-seals when not in use. The valve 4 secures itself, and consequently its bag 9, 10 is held in position mechanically.

The body portion 16, which is in the form of a plate, may engage with a portion of the manifold 8 by simple interference fit, but more preferably locating elements 6 provide a positive lock comprising an interlocking ridge and recess as shown with a recess in the manifold wall.

Assembly involves locating a valve 4 at the end of each bag 9, 10 to close the bag and allow the sealing member to be removed from the bag 9, 10 at a point above the valve 4. The valve both self-seals and locates the bag 9, 10 within the tube 1.

Thus the present invention provides a reliable way of opening and closing off collapsible bag compartments of a multi component cartridge system. A filled bag 2;9,10, with both ends sealed with a conventional sealing member, for example, with a clip, is taken and a closure device 4 is located at one end. The closure device 4 has sufficient closing force to close off the bag 2;9,10 and allow the sealing member at that end to be removed. The bag 2;9,10 is thus closed by virtue of the closure device 4, but is also ready for use. The tendency for material to flow back into the housing may also be reduced.

The closure device 4 can also assist in locating the opening of the bag 2;9,10 to maintain its position within the housing 1. This can avoid the need for additional parts to hold the bag 2;9,10 in position. For example the closure device 4 may also comprise a formation 6 that engages internally with the housing 1 to locate the dispensing end of a collapsible bag compartment 2;9,10 in position with respect to a manifold section 8 or a mixing nozzle.

The dispensing ends of the collapsible bag compartments 2;9,10 preferably communicate with a nozzle which mixes and dispenses the mixed components for use. Upstream of a dispensing nozzle, there may be a manifold section 8 having a separate manifold inlet for each dispensing end of a collapsible bag compartment and defining passages from each manifold inlet to a common manifold section 8 that supplies a dispensing nozzle. In one arrangement the closure device 4 is provided at a manifold inlet where a component is initially discharged from an opening of the collapsible bag compartment 2;9,10.

In cases where the dispensing formation connects with a downstream structure such as a mixing nozzle etc, the outlet of the dispensing device may be sealed with a removable closure which is removed to allow the attachment of the mixing nozzle. After use the removable closure can be replaced for storage and re-use. The removable closure could be a cap that acts in conjunction with set of resilient fingers to form the closure device.

Figure 4:
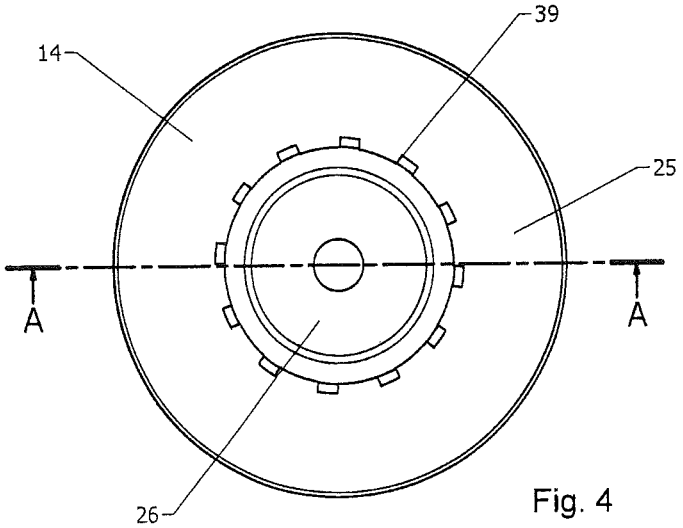
FIG. 4 is a plan view of a preferred closed dispensing device.

FIG. 4 shows a plan view of a closed dispensing device comprising an insert 25. It is fitted with a cap 26 and in a configuration ready for storage. The dispensing device is provided with a single closure device 27 (shown in FIGS. 6 and 7). It is arranged centrally, as part of the insert 25 at the outlet 7 where the dispensing end 23 or all of the dispensing ends of the capsule 2 protrude through. This arrangement is primarily designed for a multi-component dispenser device where a set of dispensing ends from the collapsible bag compartments protrude through as a common neck of material, though the closure device 27 and the insert 25 that it is part of would work equally well for single component situations where there is just a single dispensing end 23.

The head end 28 of the dispensing device, where the components are dispensed, is circular when viewed end on. The insert 25 is of a diameter at its base corresponding to the internal diameter of the elongate sleeve 1. This allows it to be inserted into the head end 28 of the elongate sleeve 1. A base region 29 of the insert 25 that fits within the sleeve 1 includes a set of slots 30. The slots 30 divide the base region 29 into a set of tabs 31, allowing the base region 29 to flex slightly during the insertion process and then grip the inside surface of the sleeve 1 once in place. These are more clearly seen in the side views of FIGS. 5 and 6.

Figure 5:
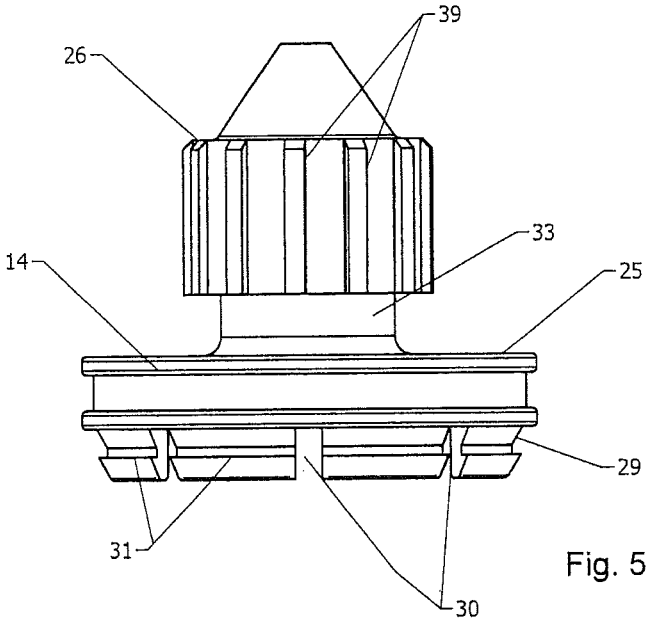
FIG. 5 is a side view of the insert of the dispensing device of FIG. 4.
Figure 6:
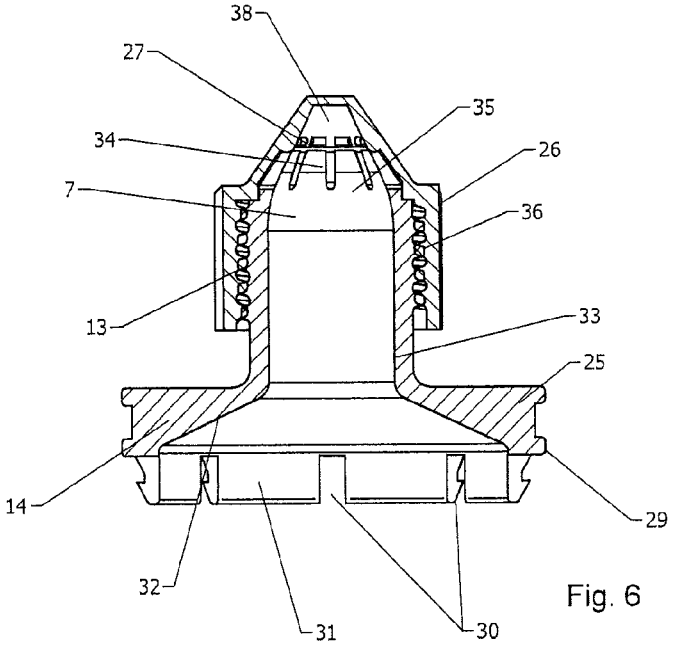
FIG. 6 is a side cross-sectional view of the insert in FIG. 5.

As shown in FIG. 5, the circular base region 29 that engages with the head end 28 of the sleeve 1, leads into a shoulder portion 14 that substantially closes off an end of the dispensing device. FIG. 6 is a cross-sectional view along A-A in FIG. 4, following the longitudinal axis of the insert, and it shows how the inside of this shoulder portion 14 is provided with a substantially conical surface 32 for directing the components within the capsule 2 towards the outlet 7. The conical surface 32 narrows to a cylindrical neck region 33, which then leads to an outlet 7 of the dispensing device, defining a funnel shape for the components (which are still housed within a capsule 2) to flow through. At the outlet 7 there is provided a closure device 27 in the form of a ring of fingers 34 defining a variable opening. Preferably the insert 25 is moulded from a plastics material having a degree of natural resilience and so the fingers 34 too, which are an integral part of the insert 25, will be resilient and are preferably moulded so as to be biased naturally towards a closed position.

As can be seen in FIG. 5, in the closed configuration the fingers 34 are urged against one another so that they touch at their side edges, particularly at their tips. The fingers 34 are inclined to the longitudinal axis of the dispensing device in the closed configuration and define a frusto-conical collar that is sized to fit tightly around a dispensing end 23 of a capsule 2 and clamp off the supply from the capsule 2 so as to prevent leakage from the various compartments. The fingers 34 hinge from a body portion 35 of material provided by the neck 33 of the insert 25. The fingers 34 may be moulded in the inclined, closed configuration; or a more open, splayed apart configuration, which may be easier to provide tooling for.

The cap 26 is provided with an internal screw thread 36 that allows it to be screwed down onto an external screw thread 13 provided on the neck 33. The screw thread 13,36 is of a size and pitch corresponding to that used on standard mixing nozzles, so that once the cap 26 has been removed, a static mixing nozzle can be fitted in its place on the insert 25 of the dispensing device. The inside of the cap 26 is moulded with a conical surface 37 that can act against the outer surface of the fingers 34. When the cap 26 is drawn down onto the outlet 7 as it is screwed onto the neck 33 of the dispensing device, the internal conical surface 37 of the cap 26 cams against the outer surface of the fingers 34 to close them down onto the surface of the capsule 2 and thereby clamp off the dispensing ends 23 of the collapsible bag compartments 9,10.

The user wishing to use the dispensing device unscrews the cap 26, releasing the fingers 34 from their closed configuration. Pressure is applied by the piston 3 of the dispensing gun to the tail end of the capsule 2 to squeeze the components up the sleeve 1 towards the dispensing ends 23 of the collapsible bag compartments 9, 10 and the outlet 7 of the dispensing device. The pressure within the capsule 2 pushes the fingers 34 apart, enabling the components to be dispensed. The fingers 34 may hinge freely from the outlet/neck region 7,33 of the insert 25 and offer little resistance to the flow of the components. Alternatively the closure device 27 may have a controlling effect on the flow of the components, for example, by providing a biased opening that offers a variable amount of resistance in response to the internal pressure generated by the compression device 3. The material of the insert 25 can be selected to provide the appropriate properties for the fingers 34 or additional devices such as resilient bands 5 or springs could be added to tune the biasing of the fingers 34 to the rheological properties of the components being dispensed.

Figure 7:
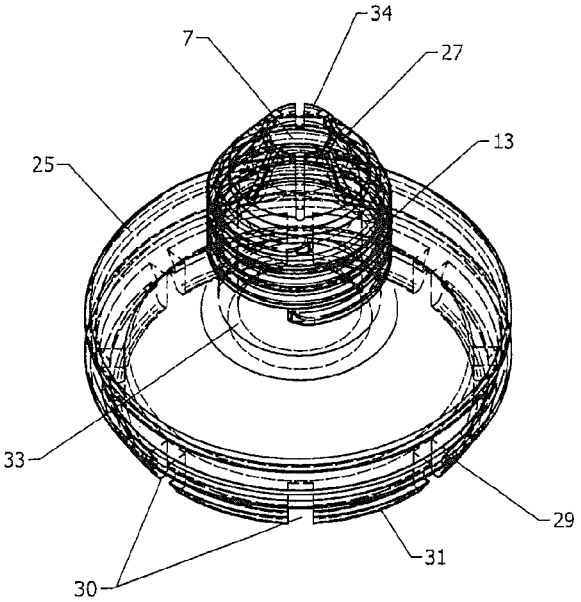
FIG. 7 is a perspective view of the insert shown in FIG. 5.
Figure 8:
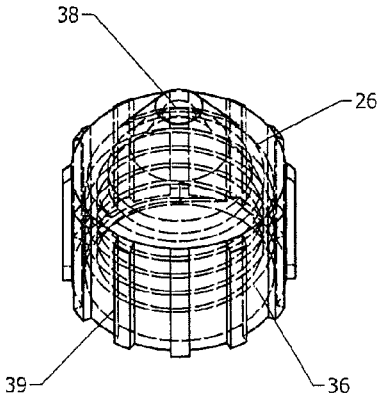
FIG. 8 is a perspective view of a preferred cap for the insert.
Figure 9:
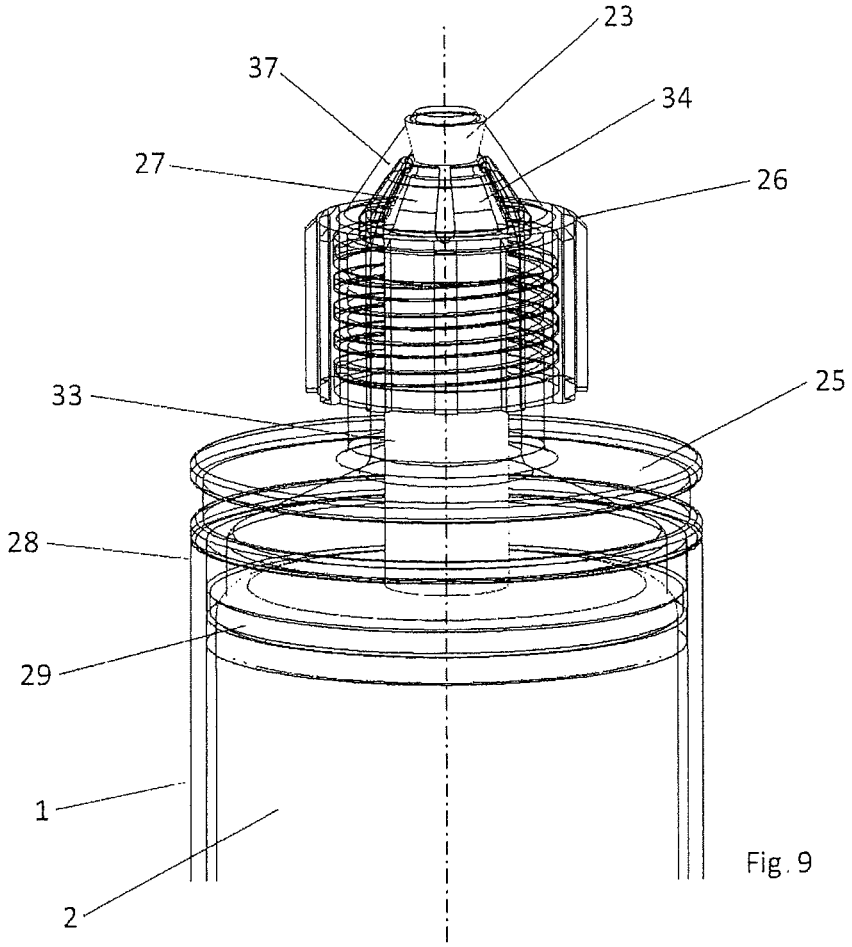
FIG. 9 is a schematic perspective view showing the preferred dispensing in a ready to use configuration with a capsule extending through the insert.

FIGS. 7 and 8 show the insert 25 and cap 26 from a perspective view. Immediately above the outlet 7, the cap 26 is provided with a head space 38 to accommodate excess film/foil material of the dispensing ends 23 extending from the point where the dispensing ends 23 are clamped to the point where the collapsible bag compartments 9,10 have been ruptured by cutting off a sealing clip.

The cap 26 further includes ribs 39 on its external surface for the user to grip when turning it.

Further preferred embodiments of the present invention will now be described by way of example with reference to the following clauses:

1. A dispensing device for an inter-reactive multi-component composition comprising a collapsible bag formation locatable within a substantially rigid housing structure and defining a plurality of compartments; each compartment housing a respective component and each compartment having a dispensing outlet at a first end of the bag adapted to communicate fluidly with a dispensing formation at a respective end of the housing structure; an opposite end of the bag formation when located within the guide tube being exposed to a compression device acting in use to tend to collapse the bag formation and encourage the components towards the respective dispensing outlets; wherein each dispensing outlet of each respective compartment is provided with an openable closure to open and close selectively during operation of the device.

2. A dispensing device in accordance with clause 1 wherein the openable closure comprises a means to open and allow extrusion of content during operation of the device and to close and seal the compartment when the device is not in use.

3. A dispensing device in accordance with clause 1 or clause 2 wherein the openable closure comprises a closure formation which is biased to a closed position so that it closes the dispensing outlet of a compartment but is adapted to open under a predetermined pressure.

4. A dispensing device in accordance with clause 3 wherein the closure formation is a one-way closure valve.

5. A dispensing device in accordance with any preceding clause wherein the openable closure further comprises a means to assist in the mechanical location of the associated dispensing outlet of a compartment in position to communicate fluidly with a dispensing formation of the housing structure.

6. A dispensing device in accordance with clause 5 wherein the openable closure comprises a closure formation adapted in use to open and close the dispensing outlet of a compartment selectively and a body formation adapted in use to engage internally in mechanical association with the housing structure to locate the dispensing outlet of a compartment in position to communicate fluidly with a dispensing formation of the housing structure.

7. A dispensing device in accordance with any preceding clause housed for use in a substantially rigid housing structure having a dispensing formation at a first end of the housing structure and a compression device remote from the first end of the housing structure; whereby each dispensing outlet at the first end of the bag fluidly communicates with the dispensing formation at the respective end of the housing structure; and whereby an opposite end of the bag is located within the housing structure such as to be acted upon in use by the compression device to tend to collapse the bag formation and encourage the components towards the respective dispensing outlets.

8. A dispensing device in accordance with any preceding clause wherein the collapsible bag formation comprises a flexible bag having multiple compartments.

9. A dispensing device in accordance with any preceding clause wherein the collapsible bag formation comprises a plurality of flexible bags each defining a single compartment.

10. A dispensing device in accordance with any preceding clause wherein the collapsible bag formation comprises a flexible membrane defining each compartment to house a fluid component.

11. A dispensing device in accordance with clause 10 wherein the flexible membrane is conveniently a flexible material.

12. A dispensing device in accordance with any preceding clause wherein the dispensing formation includes a nozzle through which the mixed components may be dispensed for use.

13. A dispensing device in accordance with any preceding clause wherein the dispensing formation includes a manifold having a separate manifold inlet in fluid communication with each dispensing outlet of a compartment of a bag and defining fluid flow passages from each manifold inlet to a common fluid conduit.

14. A dispensing device in accordance with clause 13 wherein the openable closure comprises engagement formations to engage with the manifold to locate the closure at a suitable point within the manifold.

15. A dispensing device in accordance with any preceding clause wherein the openable closure comprises engagement formations to engage with an internal wall of the housing to locate the closure at a suitable point within the housing.

16. A dispensing device in accordance with any preceding clause wherein the housing structure is a hollow elongate tube.

17. A dispensing device in accordance with any preceding clause wherein the housing structure is adapted to serve as a guide means for deployment of the compression device in use.

18. A dispensing device in accordance with clause 17 wherein the compression device deploys along the housing structure in an elongate direction and the housing structure is adapted to serve as a guide means for such deployment.

19. A dispensing device in accordance with any preceding clause wherein the compression device is a piston.

20. A dispensing apparatus comprising a substantially rigid, elongate sleeve that is able to receive a piston at one end, a capsule fitted within the sleeve, the capsule comprising a flexible film package and containing two or more components housed within elongate chambers defined by flexible film, the capsule being sealed at one end where the piston will apply pressure and at the other dispensing end, either having one or more seals that is or are capable of rupturing or being ruptured, or having a pre-ruptured opening for dispensing the components to an outlet of the dispensing apparatus, wherein the dispensing apparatus includes an insert within the sleeve, the insert being provided with a biased opening, for example, a resilient orifice, that fits over a dispensing end of the capsule such that the flexible film of the capsule extends through the biased opening towards a point of rupture.

The invention claimed is:

1. A re-sealable and re-useable dispensing device for a multi-component composition, the dispensing device comprising a housing generally in the form of an elongate sleeve having a first end for receiving a compression device and a second end defining shoulders that taper to an outlet from which a supply of components housed within the housing are to be dispensed, wherein each component is retained within a compartment of a collapsible bag prior to being dispensed, the collapsible bag compartments each having a sealed end for receiving pressure from the compression device and a dispensing end, which has been ruptured or is capable of rupturing, for dispensing a component via the outlet, wherein the dispensing device is provided with a closure device that the dispensing ends of the collapsible bag compartments are arranged to extend through, the closure device being adapted to apply a clamping force on the dispensing ends to seal off, or to re-seal, the supply of the components until the next use and to release the clamping force when required to allow the components to be dispensed, wherein the closure device comprises a plurality of fingers that are arranged in a ring extending around an aperture to clamp off the dispensing ends of the collapsible bag compartments, and wherein the closure device cooperates with a rotatable member in the form of a cap, which is turned from a first position to a second position to open and close off the closure device, and wherein the cap screws onto an external screw thread provided on an external surface of a neck region, the cap being unscrewed and replaced with a dispensing nozzle prior dispensing the components.

2. A dispensing device as claimed in claim 1, wherein the closure device is located at the outlet of the housing.

3. A dispensing device as claimed in claim 1, wherein a surface of the rotatable member urges against a surface of the fingers, forcing the fingers together.

4. A dispensing device as claimed in claim 1, wherein the collapsible bag compartments are ruptured prior to fitting the rotatable member onto the closure device.

5. A dispensing device as claimed in claim 1, wherein the cap has an internal surface profile that provides a recess which extends over the outlet of the dispensing device for accommodating excess material of the dispensing ends.

6. A dispensing device as claimed in claim 1, wherein the collapsible bag compartments are defined by formations within a single capsule, the dispensing ends forming a common dispensing end that protrudes through the closure device.

7. A re-sealable and re-useable dispensing device for a multi-component composition, the dispensing device comprising a housing generally in the form of an elongate sleeve having a first end for receiving a compression device and a second end defining shoulders that taper to a neck leading to an outlet of the dispensing device from which a supply of components housed within the housing are to be dispensed, wherein each component is retained within a compartment of a collapsible bag prior to being dispensed, the collapsible bag compartments each having a sealed end for receiving pressure from the compression device and a dispensing end, which has been ruptured or is capable of rupturing, for dispensing a component via the outlet, wherein the dispensing device is provided with at least one closure device that the dispensing ends of the collapsible bag compartments are arranged to extend through, the at least one closure device being adapted to apply a clamping force on the dispensing ends to seal off, or to re-seal, the supply of the components until the next use and to release the clamping force when required to allow the components to be dispensed, wherein the at least one closure device comprises a plurality of fingers that are arranged to clamp off the dispensing ends of the collapsible bag compartments, wherein the at least one closure device is provided in an insert mounted within the dispensing device at a location upstream of the neck.

8. A dispensing device as claimed in claim 7, wherein the at least one closure device is provided within the housing at an entrance to a manifold section, the manifold section defining chambers that the components flow through to the outlet of the dispensing device.

9. A dispensing device as claimed in claim 8, wherein the collapsible bag compartments have dispensing ends that are spaced from one another, and the at least one closure device comprising a closure device provided for each dispensing end to open and allow extrusion of a component during operation of the dispensing device and to close and seal the respective compartment when the device is not in use.

10. A dispensing device as claimed in claim 9, wherein the plurality of fingers are arranged in a ring extending around an aperture that the dispensing end protrudes through.

11. A dispensing device as claimed in claim 9, wherein the collapsible bag compartments are provided by more than one capsule housed within the sleeve.

* * * * *